US006199457B1

(12) United States Patent
Hoff et al.

(10) Patent No.: US 6,199,457 B1
(45) Date of Patent: Mar. 13, 2001

(54) QUICK RELEASE MECHANISM FOR SOCKET DRIVE TOOL

(75) Inventors: Jeffrey H. Hoff, Kenosha; Frank Mikic, deceased, late of Lake Geneva, both of WI (US), by Daniel J. Garramone, legal representative

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

(21) Appl. No.: 09/399,598

(22) Filed: Sep. 20, 1999

Related U.S. Application Data

(63) Continuation-in-part of application No. 09/076,995, filed on May 13, 1998.

(51) Int. Cl.[7] ..... B25B 23/16
(52) U.S. Cl. ..... 81/177.85; 403/325
(58) Field of Search ..... 81/177.2, 177.85; 403/325, 365, 367

(56) References Cited

U.S. PATENT DOCUMENTS 4,988,248 * 1/1991 Flux ..... 403/328 X
5,329,954 * 7/1994 Miyoshi ..... 403/325 X
5,566,595 * 10/1996 Goff ..... 81/177.85

* cited by examiner

*Primary Examiner*—James G. Smith
(74) *Attorney, Agent, or Firm*—Seyfarth Shaw

(57) ABSTRACT

A socket drive tool has an elongated shaft defining a coupling body at one end thereof with a square drive lug having a detent ball disposed in a recess therein and projecting from a face thereof. A link pin reciprocates in the body and has a cam surface at one end thereof engageable with the ball, the pin being spring biased to a condition holding the ball in a retaining position projecting from the recess, and movable against the spring bias to a releasing condition permitting the ball to retract into the recess. An opening in the body is generally oblong in transverse cross section and tapers from a wide outer end to a narrow inner end, and then tapers back out again a short distance from the narrow inner end. The link pin has formed diametrically therethrough a reverse tapered aperture which tapers from a narrow end near the wide end of the opening to an oblong wide end near the inner end of the opening. An actuator pin extends into the opening and through the aperture, being seated in the inner end of the opening, the outer end of the actuator pin projecting from the opening for manual access by a user to pivot the pin and thereby reciprocate the link pin. An outer lip portion of the opening has a width slightly less than an enlarged annular flange portion of the actuator pin to retain the pin in the housing.

18 Claims, 1 Drawing Sheet

QUICK RELEASE MECHANISM FOR SOCKET DRIVE TOOL

CROSS REFERENCE TO RELATED APPLICATIONS

This is a continuation-in-part of application Ser. No. 09/076,995, filed May 13, 1998.

BACKGROUND OF THE INVENTION

The present invention relates to socket drive tools and, in particular, to drive tools with quick release mechanisms to facilitate mounting and demounting of associated sockets on the drive tool A socket drive tool typically has a drive lug at one end, usually square in transverse cross section, adapted to be mateably received in a square drive receptacle end of the associated socket tool. The square drive lug on the drive tool usually has a detent ball seated in a recess and spring loaded outwardly for engagement in a complementary recess in the inner face of the socket, to resiliently retain the socket in place on the drive tool. The spring loading force on the ball is usually such as to permit manual mounting and demounting of the socket on the drive tool, while inhibiting inadvertent disconnection of the parts.

It is known to provide a locking type of mechanism for such a detent ball, wherein a pin or similar member reciprocates in a bore in the drive tool between a retaining condition, wherein the pin forces the ball out of the recess, and a releasing condition, wherein the pin is retracted to allow retraction of the ball into the recess. Typically the pin is spring loaded to its retaining condition and is manually movable to its retracted or releasing condition by means of an actuator member, which is coupled to the pin but is manually accessible by a user to reciprocate with the pin. Commonly, such quick-release arrangements are designed so that when the pin is in its retaining condition, the detent ball is locked in its outwardly projecting or socket-retaining position, so that a socket either cannot be mounted or demounted or is very difficult to mount and demount manually. When the detent ball is recessed by retracting the pin to its releasing condition, the socket can be easily mounted and demounted without interference by the detent ball. However, the use of a reciprocating actuator for effecting movement of the reciprocating pin is mechanically inefficient and may require the exertion of considerable force by the user's finger, thumb or the like.

SUMMARY OF THE INVENTION

It is a general object of the invention to provide an improved socket drive tool of the quick release type which avoids the disadvantages of prior tools while affording additional structural and operating advantages.

An important feature of the invention is the provision of a socket drive tool of the type set forth wherein the quick release mechanism is mechanically efficient.

In connection with the foregoing feature, another feature of the invention is the provision of a socket drive tool of the type set forth, with a pivoting actuator for the quick release mechanism.

Still another feature of the invention is the provision of a socket drive tool of the type set forth, which is of simple and economical construction.

Certain ones of these and other features of the invention are attained by providing a socket drive tool for use with a socket, the drive tool comprising: a body having a coupling structure for coupling to an associated socket; the coupling structure including a detent recess and a detent member disposed in the recess and movable between retaining and releasing positions relative to the associated socket; the body having a cavity therein communicating with the detent recess and an opening into the cavity; a link member having an aperture therethrough and disposed in the cavity for contact with the detent member and being reciprocatively movable between a retaining condition holding the detent member in its retaining position and a releasing condition accommodating movement of the detent member to is releasing position; and an actuator coupled to the link member by extending through the aperture and projecting from the opening for access by a user at one side of the link member for pivoting the actuator about a pivot axis on the opposite side of the link member, thereby to manually effect reciprocating movement of the link member between its retaining and releasing conditions.

Other features of the invention are attained by providing a socket drive tool of the type described, wherein the actuator is carried by the body for pivotal movement relative thereto.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
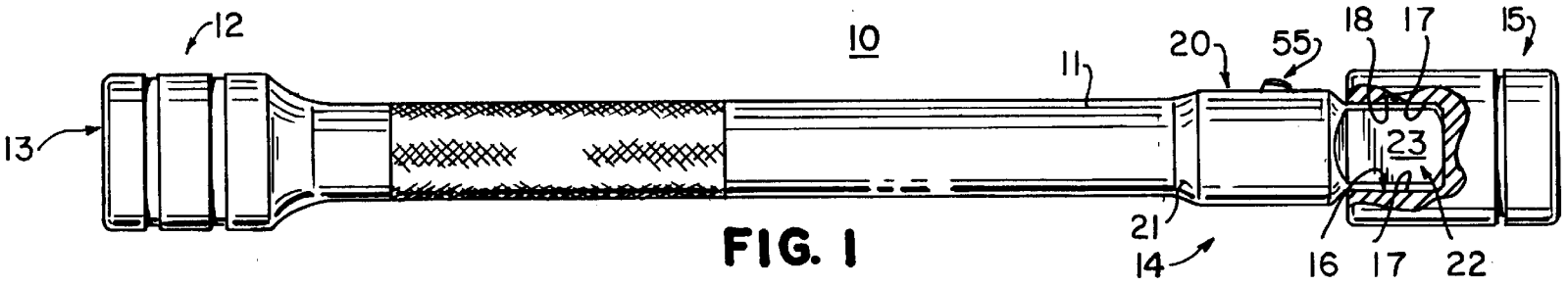
FIG. 1 is a side elevational view of a socket drive tool in accordance with the present invention with an associated socket shown mounted thereon in partial section to illustrate internal construction.
Figure 2:
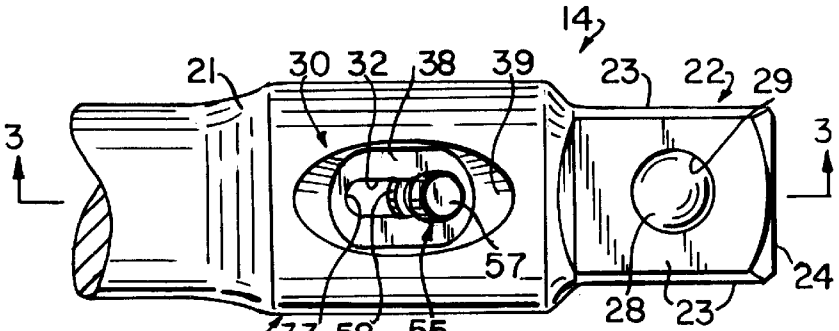
FIG. 2 is an enlarged, fragmentary top plan view of the socket coupling end of the drive tool of FIG. 1 in its retaining configuration.

Referring now to FIG. 1, there is illustrated a drive tool in the nature of an extension, generally designated by the numeral 10, constructed in accordance with the present invention. The tool 10 has an elongated shaft 11 provided with a female coupling end 12 which defines a socket receptacle 13 for receiving an associated male driving element, such as a square drive lug of an associated drive tool. The shaft 11 is also integral with a male coupling end 14 for coupling to an associated socket 15. The socket 15 is typically provided with a square receptacle 16 having four side faces 17, at least one of which is provided with a concave detent recess 18, all in a known manner. It will be appreciated that the socket 15 is typically provided at its other end thereof with a driving recess (not shown) of polygonal cross section, such as hexagonal, for mateably receiving an associated fastener or the like to be driven.

Formed at the male coupling end 14 of the shaft 11 is a coupling body 20, which may have an enlarged diameter and be coupled to the main length of the shaft 11, as by a frustoconical shoulder 21. The coupling body 20 includes a square drive lug 22 having four rectangular side faces 23 and a square end face 24 dimensioned to be received in the square drive receptacle 16 of the associated socket 15. Formed in the end face 24 is an elongated axial bore 25, which extends substantially the entire length of the coupling body 20 and defines a cavity therein. Also formed through one of the side faces 23 centrally thereof is a radial bore defining a detent recess 27, the recess 27 communicating with the cavity formed by the axial bore 25. A detent ball 28 is disposed in the recess 27, and a lip 29 (see FIG. 3) of the recess 27 is typically formed over to a diameter slightly less than that of the detent ball 28 to prevent escape of the ball 28 from the recess 27.

Also formed radially in the coupling body 20, generally parallel to the axis of the radial recess 27, is an opening 30 which has a main portion 31 which tapers inwardly to a narrow end. Adjacent to its outer or open end, the main portion 31 of the opening 30 is generally oblong in shape, having a pair of opposed parallel side walls 32 and opposed arcuate end walls 33, the latter of which taper inwardly of the coupling body 20 toward each other to a narrow inner end 34 (FIG. 3), which is substantially circular in transverse cross section. Thus, the lengths of the side walls 32 decrease or taper inwardly. The walls of opening 30 then widen out again in a reverse sloping portion 35, terminating at an inner end wall 36. The outer end of the main portion 31 is formed over after assembly to define a lip 37. Surrounding the lip 37 is an oval planar apron 38, which lies in a plane substantially perpendicular to the axis of the opening 30 and is continuous along its periphery with an outwardly diverging entry portion 39.

Received coaxially in the axial bore 25 is a cylindrical link pin 40 having an inner end face 41 and an outer end face 42. Formed adjacent to the outer end of the link pin 40 is an arcuate cam surface 43, which includes a concave portion 44 having a diameter substantially the same as that of the detent ball 28, and a convex portion 45 which intersects the end face 42 substantially at the longitudinal axis of the pin 40. Formed radially through the link pin 40 is a tapered aperture 46, which diverges from a substantially circular narrow end 47 to an oblong wide end 48, the aperture 46 having arcuate, sloping end walls 49. Thus, it will be appreciated that the aperture 46 has a shape somewhat similar to that of the opening 30, but is sloped or tapered in an opposite direction, so that the narrow end of the aperture 46 is near the wide end of the opening 30, and vice versa.

Figure 3:
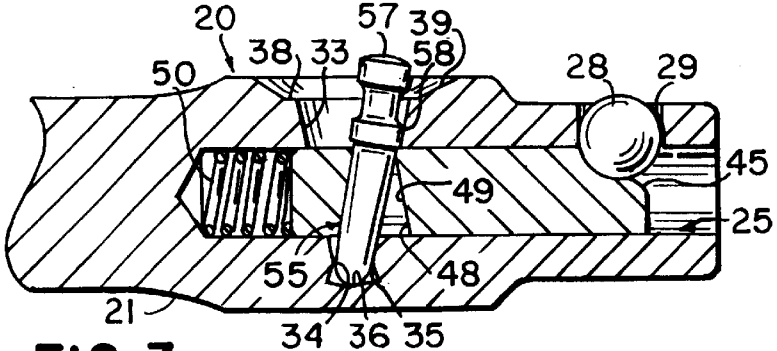
FIG. 3 is a view in vertical section taken along the line 33 in FIG. 2.

Disposed in the axial bore 25 inwardly of the link pin 40 is a helical compression spring 50, which bears against the inner end face 41 of the link pin 40 for resiliently urging it axially outwardly to a retaining or locking condition, illustrated in FIG. 3. In this locking condition, the cam surface 43 drives the detent ball 28 radially outwardly of the detent recess to its retaining position. It will be appreciated that the link pin 40 is reciprocatively movable between the retaining position of FIG. 3 and a releasing position illustrated in FIG. 4, in which the spring 50 is compressed, and the detent ball 28 is supported on the convex portion 45 of the cam surface 43, accommodating full retraction of the detent ball 28 into its recess 27. The parts are so dimensioned that the ball 28 cannot escape through the outer end of the axial bore 25.

It is a significant aspect o f the invention that the drive tool 10 also includes an elongated actuator pin 55, which is disposed in use in the opening 30 and through the aperture 46. The actuator pin 55 has a diameter which is slightly less than the diameters of the inner end 34 of the opening 30 and the narrow end 47 of the aperture 46. The actuator pin 55 has a generally hemispherical inner end 56, which seats against the end wall 36 of the opening 30 and preferably has a radius substantially equal to the distance between the bottom of the end wall 36 and the inner end 34 of the opening 30, as measured axially of the opening 30. Thus, it will be appreciated that the circular inner end 34 of the opening 30 defines a bearing plane in which lies a pivot axis "X" (FIG. 4), about which the actuator pin 55 can pivot, this pivotal movement being accommodated by the oblong shapes of the opening 30 and the aperture 46. Preferably, the actuator pin 55 has a length such that it extends a slight distance outwardly beyond the periphery of the coupling body 20 and is provided with an enlarged head 57 to facilitate manual engagement thereof by a user's finger or thumb. The actuator pin 55 is provided intermediate its inner and outer ends with an enlarged-diameter annular retaining flange 58, the diameter of which is slightly greater than the distance between the opposite side edges of the lip 37 to retain the actuator pin 55 in place in the opening 30. In this regard, the lip 37 is preferably formed over to the desired dimension after assembly of the drive tool 10.

In use, it will be appreciated that the link pin 40 is normally biased to its retaining position illustrated in FIG. 3, holding the detent ball 28 in its projecting or retaining position. When it is desired to retract the link pin 40, the head 57 of the actuator pin 55 is engaged by a user's finger or thumb, and the actuator pin 55 is pivoted rearwardly to the releasing condition illustrated in FIG. 4, thereby retracting the link pin 40 to its releasing condition and accommodating movement of the detent ball 28 to its retracted or releasing position. When the actuator pin 55 is released, the spring 50 will automatically drive the parts back to the original retaining or locking condition of FIG. 3.

Figure 4:
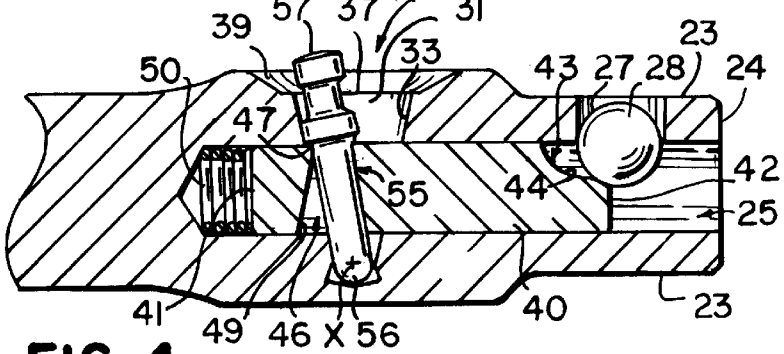
FIG. 4 is a view similar to FIG. 3, with the mechanism shown in its releasing configuration.

Accordingly, when it is desired to mount a socket 15 on the drive lug 22, the actuator pin 55 is pivoted to its releasing condition of FIG. 4, wherein the detent ball 28 does not interfere with mounting of the socket 15. Then, the actuator pin 55 is released, and the detent ball 28 is driven back out into the associated detent recess 18 in the socket 15, securely retaining or locking the socket 15 in place. It can be seen that the shape of the cam surface 43 is such that when the socket 15 is locked in place on the drive lug 22 it will be extremely difficult, if not impossible, to manually remove the socket 15 from the drive lug 22, whereby it is effectively locked in place. Thus, when it is desired to remove the socket 15, the actuator pin 55 is again pivoted to its releasing condition.

It can be seen that the above-described construction provides an actuator pin which pivots and operates as a lever, providing significant mechanical advantage and facilitating movement of the parts from the retaining to the releasing conditions thereof.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A socket drive tool for use with a socket, the drive tool comprising:

a body having a coupling structure for coupling to an associated socket;

the coupling structure including a detent recess and a detent member disposed in the recess and movable between retaining and releasing positions relative to the associated socket;

the body having a cavity therein communicating with the detent recess and an opening into the cavity;

a link member having an aperture therethrough and disposed in the cavity for contact with the detent member and being reciprocatively movable between a retaining condition holding the detent member in its retaining position and a releasing condition accommodating movement of the detent member to its releasing position; and an actuator coupled to the link member by extending through the aperture and projecting from the opening for access by a user at one side of the link member for pivoting the actuator about a pivot axis on an opposite side of the link member, thereby to manually effect reciprocating movement of the link member between its retaining and releasing conditions.

2. The tool of claim 1, wherein the aperture is dimensioned to freely accommodate the actuator therethrough.

3. The tool of claim 1, wherein the opening is elongated in the direction of movement of the link member.

4. The tool of claim 1, wherein the opening has a lip portion adjacent to an outer surface of the body, the actuator having an enlarged portion disposed in use internally of the body and dimensioned so that it cannot pass through the lip portion of the opening, thereby to retain the actuator in place in the body.

5. The tool of claim 1, wherein each of the link member and the actuator is in the form of an elongated pin.

6. The tool of claim 1, and further comprising a bias spring disposed in the cavity and resiliently biasing the link member to the retaining condition thereof.

7. The tool of claim 1, wherein the link member has a cam surface disposed for camming engagement with the detent member for camming the detent number to the retaining position thereof in response to movement of the link member to the retaining condition thereof, the cam surface extending along only about half the transverse thickness of the link member.

8. A socket drive tool for use with a socket, the drive tool comprising:

a body having a coupling structure for coupling to an associated socket;

the coupling structure including a detent recess and a detent member disposed in the recess and movable between retaining and releasing positions relative to the associated socket;

the body having a cavity therein communicating with the detent recess and an opening into the cavity;

a link member disposed in the cavity for contact with the detent member and being reciprocatively movable along a path between a retaining condition holding the detent member in its retaining position and a releasing condition accommodating movement of the detent member to its releasing position; and an actuator coupled to the link member and carried by the body for pivotal movement relative thereto, the actuator projecting from the opening for access by a user at one side of the link member, the opening being shaped and dimensioned to accommodate pivoting of the actuator about a pivot axis on an opposite side of the link member to effect movement of the link member between its retaining and releasing conditions.

9. The tool of claim 8, wherein the opening is tapered from a relatively wide outer end adjacent to an external surface of the body to a relatively narrow inner end within the body.

10. The tool of claim 9, wherein the inner end of the opening has a reverse tapered portion which widens slightly from a minimum width region.

11. The tool of claim 8, wherein the link member has a cam surface disposed for camming engagement with the detent member for camming the detent member to the retaining position thereof in response to movement of the link member to the retaining condition thereof, the cam surface extending along only about half the transverse thickness of the link member.

12. The tool of claim 8, wherein the detent member is a detent ball.

13. The tool of claim 8, and further comprising a bias spring disposed in the cavity and resiliently biasing the link member to the retaining condition thereof.

14. A socket drive tool for use with a socket, the drive tool comprising:

a body having a coupling structure for coupling to an associated socket;

the coupling structure including a detent recess and a detent member disposed in the recess and movable between retaining and releasing positions relative to the associated socket;

the body having a cavity therein communicating with the detent recess and an opening into the cavity;

a link member having an aperture therethrough and disposed in the cavity for contact with the detent member and being reciprocatively movable between a retaining condition holding the detent member in its retaining position and a releasing condition accommodating movement of the detent member to its releasing position; and an actuator coupled to the link member by extending through the aperture and carried by the body for pivotal movement relative thereto to effect movement of the link member between its retaining and releasing conditions, the actuator projecting from the opening for access by a user at one side of the link member for pivoting the actuator about a pivot axis on an opposite side of the link member.

15. The tool of claim 14, wherein the aperture is dimensioned to freely accommodate the actuator therethrough.

16. The tool of claim 14, wherein the opening is elongated in the direction of movement of the link member.

17. The tool of claim 14, wherein the opening has a lip portion adjacent to an outer surface of the body, the actuator having an enlarged portion disposed in use internally of the body and dimensioned so that it cannot pass through the lip portion of the opening, thereby to retain the actuator in place in the body.

18. The tool of claim 14, wherein the opening is tapered from a relatively wide outer end adjacent to an external surface of the body to a relatively narrow inner end within the body, and the aperture is tapered from a relatively narrow first end adjacent to the outer end of the opening to a relatively wide second and adjacent to the inner end of the opening.

* * * * *